United States Patent [19]

Smith

[11] 4,045,603

[45] Aug. 30, 1977

[54] CONSTRUCTION MATERIAL OF RECYCLED WASTE THERMOPLASTIC SYNTHETIC RESIN AND CELLULOSE FIBERS

[75] Inventor: Teddy Van Smith, Dallas, Tex.

[73] Assignee: Nora S. Smith, Dallas, Tex.

[21] Appl. No.: 625,896

[22] Filed: Oct. 28, 1975

[51] Int. Cl.[2] ..... B65D 71/00

[52] U.S. Cl. ..... 428/2; 428/61; 428/511; 428/537; 428/144; 428/147; 428/51; 425/131.1; 156/62.2; 156/244; 264/115; 264/DIG. 69

[58] Field of Search ..... 428/57, 61, 511, 537, 428/2, 144, 147; 156/62.2, 244; 264/115

[56] References Cited

U.S. PATENT DOCUMENTS

| | | | |
|---|---|---|---|
| 3,671,615 | 6/1972 | Price | 428/2 X |
| 3,746,610 | 7/1973 | Hoegger | 428/2 X |
| 3,956,541 | 5/1976 | Pringle | 428/2 |

*Primary Examiner*—P. C. Ives

*Attorney, Agent, or Firm*—Warren H. Kintzinger

[57] ABSTRACT

A three layer building panel material product made from recycled waste thermoplastic synthetic resin material and cellulose fibers aggregate, outer layers of which substantially comprise reset pressure rolled, heat-fused, and re-hardened thermoplastic synthetic resin bits, and having a core of cellulose fiber aggregate bonded by re-hardened heat-fused thermoplastic synthetic resin bits pressure bonded to the outer layers.

6 Claims, 3 Drawing Figures

Figure 1:
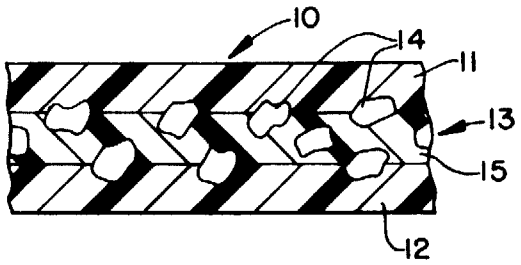

CONSTRUCTION MATERIAL OF RECYCLED WASTE THERMOPLASTIC SYNTHETIC RESIN AND CELLULOSE FIBERS

This invention relates in general to new compositions of matter, and in particular to a new composition material useful as a wall panel product in the construction industry.

Conventional wall construction has long utilized studding and framing, with surface material of one type or another placed thereover to complete the wall. Conventional hollow-wall construction techniques employ the use of expensive wood framing materials (i.e., dimension lumber), to arrive at a structurally rigid wall structure having load-carrying capabilities. The conventional framing is surfaced with sheetrock, wood paneling, or other planar materials, resulting in time-consuming construction with attendant appreciable expense.

Often, the expense of conventional housing construction denies adequate housing. Also denying housing to many, is the shortage of lumber and paneling materials. Methods for overcoming the time-consuming construction and the high cost of conventional wall panels have included various wall paneling materials using cellulose fiber materials and a bonding agent. Thermoplastics have been used in wall panels in the form of foaming ureathanes. Generally these products and the methods by which they are manufactured do not provide cost reduction, because the materials are expensive and the cost of manufacture precludes a low-priced product.

The present invention provides a new and useful wall panel product that may be manufactured—as described and claimed in my concurrently filed co-pending application, Ser. No. 625,897 entitled, "Extruded Panel Product, Apparatus and Process," assigned to the assignee of the present invention, now U.S. Pat. 3,995,980, dated Dec. 7, 1976, -by a continuous extrusion process utilizing, as raw materials, those materials heretofore considered to be discardable waste products; namely, discarded thermoplastic synthetic resin bottles, toys, tires, cartons, containers, etc., and cellulose fiber products, such as shredded tree bark.

It is therefore a principal object of this invention to provide a new wall panel product, with the product being producible from extremely low-cost raw materials, and which wall paneling will vastly reduce both home building and commercial construction time and costs.

Another object of the invention is to provide a new and novel wall panel product for use in construction that is equally economical and useful for both supporting wall structures and non-supporting wall structures.

A further object of the invention is to provide a new wall panel product made from raw materials heretofore considered to be waste.

A still further object of the invention is to provide an economical wall paneling product made from reclaimed waste materials.

Another object of the invention is to provide a wall paneling product comprised of reclaimed thermoplastic synthetic resin material and wood particles of regular or irregular size, and having improved characteristics of strength, durability, corrosion resistance, repairability, and insulating qualities, as compared to conventional wood frame wall panels.

The product is diagramatically depicted in the drawing.

Figure 2:
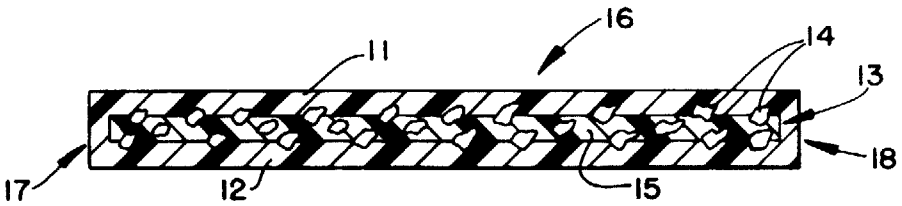

IN THE DRAWING:

FIG. 1 illustrates, diagramatically, a cross section of the wall paneling material;

FIG. 2, a cross section of the product as employed in a wall panel; and

Figure 3:
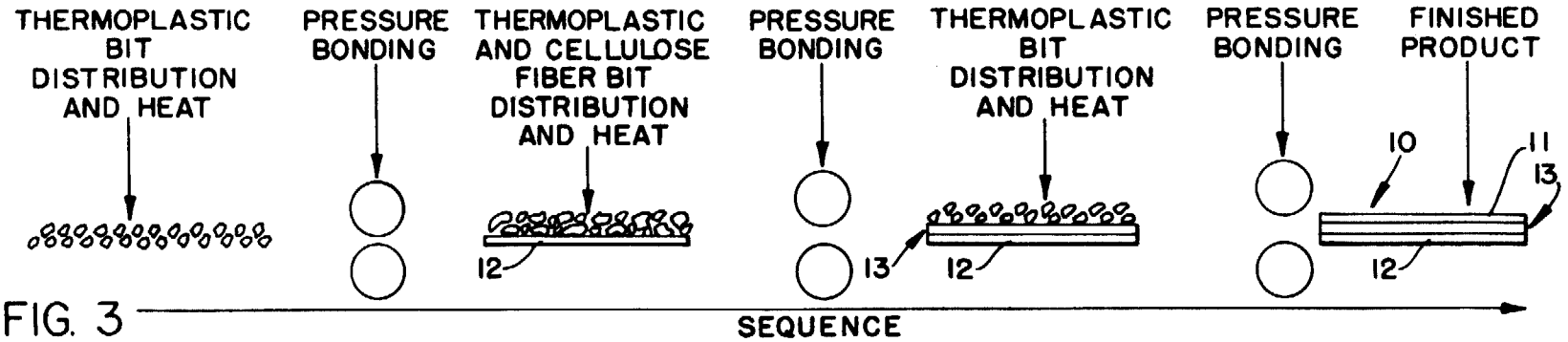

FIG. 3, a process flow diagram for making the product.

Referring to the drawing:

The product 10 is comprised of a sandwich-like multi-layered panel including outer layers 11 and 12 which substantially comprise a pressure rolled planar surface of heat-fused and re-hardened shredded thermoplastic synthetic resin material bits. Between the outside surface layers 11 and 12 is a core material 13 comprised of a pressure bonded mixture of shredded cellulose fiber material bits 14 and heat-fused and re-hardened thermoplastic synthetic resin material bits 15, the latter acting as a bonding agent for the cellulose fiber bits 15.

As depicted in FIG. 2, the material may be formed into a panel member 16 of selected dimensions with the sides 17 and 18 of the material additionally comprising a fused and pressure rolled re-hardened layer of thermoplastic synthetic resin material bits pressure bonded to the side extremes of the panel.

The cellulose fiber bits, in a preferred embodiment, might comprise shredded and/or chapped tree bark.

Thermoplastic synthetic resin material useful in making the product may comprise discarded plastic bottles, toys, cartons, containers, shredded to facilitate even distribution on planar work surface. Thermoplastic synthetic resin materials, when heated to a temperature of, for example, 500° Fahrenheit or less, form a molten, pliable, material. In this pliable state, by use of rollers, or other pressure applying devices, the material can be shaped into a desired pattern, and, when cooled, the material once again becomes rigid. When mixed with an aggregate and heated, and pressure applied to the mixture, a non-uniform mass is created. The application of thermoplastic synthetic resin material to both sides of the aggregate-plastic slab creates a structure comparable to conventional wood-constructed paneling.

The core of the material, using the tree bark as aggregate, and thermoplastic synthetic resin as bonding agent, provides unusual strength to the product, while the outer surface layers of thermoplastic synthetic resin provide a relatively smooth surface for finishing purposes and advantageously provide a moisture seal for the product. When fashioned with thermoplastic outer layers on the sides, relatively smooth end surfaces are realized for gluing and nailing purposes.

The paneling product may be prepared by heat fusing a first layer of shredded thermoplastic synthetic resin material, pressure rolling the first layer, distributing, over the pressure-rolled first layer, an intermediate layer of shredded, heat-fused, thermoplastic synthetic resin material mixed with cellulose fiber particles, pressure bonding the intermediate layer onto the first layer, distributing a top layer of shredded thermoplastic synthetic resin over the intermediate layer, heat-fusing the top layer, followed by further pressure bonding of the three-layer product, whereby the thermoplastic material is caused to act as a bonding agent for the cellulose fiber particles, with the latter acting as a strengthening core aggregate for the paneling.

FIG. 3 depicts a generalized process flow diagram for making the product. Pressure rollers are functionally depicted as effecting the sequential pressure bonding, it being realized that other compressive means might be utilized.

Whereas this invention is herein described with respect to a preferred embodiment, it should be realized that various changes may be made without departing from the essential contributions to the art made by the teachings hereof.

I claim:

1. A construction material comprising respective opposite face surfaces, said opposite face surfaces being contiguous with an intervening core material, said face surfaces consisting essentially of a re-hardened fused and rolled layer of thermoplastic synthetic resin material bits, said intervening core material consisting essentially of a compressed non-homogeneous mixture of cellulose aggregate material bits and re-hardened fused thermoplastic synthetic resin material bits, with said face surfaces being fused to respective opposite surfaces of said intervening core material.

2. The material of claim 1, with respective opposite edges between said face surfaces consisting essentially of a re-hardened fused thermoplastic synthetic resin material bit layer fused respectively to the respective edge extremes of said face surfaces and intervening core material.

3. The material of claim 2, with said cellulose aggregate material including chopped tree bark.

4. A construction material consisting essentially of a pressure rolled non-homogeneous mixture of cellulose aggregate and re-hardened fused thermoplastic synthetic resin material bits.

5. The material of claim 4, with additional layers consisting essentially of re-hardened, fused, thermoplastic synthetic resin material bits on respective opposite planar surfaces, said additional layers being integrally fused to the intervening aggregate-containing portion of said material to define substantially uniformly smooth material planar surfaces.

6. The material of claim 5, with said cellulose aggregate including chopped tree bark.

* * * * *